US005913489A

United States Patent [19]

Rodriquez et al.

[11] Patent Number: 5,913,489

[45] Date of Patent: Jun. 22, 1999

[54] CONTINUOUS WEB MATERIAL TURN UP SYSTEM AND METHOD

[75] Inventors: Peter A. Rodriquez; Robert M. Lincoln, both of Jacksonville, Fla.

[73] Assignee: Sandar Industries, Inc., Atlantic Beach, Fla.

[21] Appl. No.: 09/010,779

[22] Filed: Jan. 22, 1998

Related U.S. Application Data

[63] Continuation-in-part of application No. 08/934,557, Sep. 22, 1997.

[51] Int. Cl.[6] ..... B65H 19/26

[52] U.S. Cl. ..... 242/526.2

[58] Field of Search ..... 242/526.2, 541, 242/542.3

[56] References Cited

U.S. PATENT DOCUMENTS

| | | | |
|---|---|---|---|
| 2,343,047 | 2/1944 | Doyle et al. | 242/526.2 |
| 3,096,947 | 7/1963 | Jacobs et al. | 242/526.2 |
| 4,414,258 | 11/1983 | Corbin | 242/526.2 |
| 4,659,029 | 4/1987 | Rodriguez | 242/526.2 |
| 4,783,018 | 11/1988 | Rodriguez | 242/526.2 |
| 4,964,584 | 10/1990 | Taipale et al. | 242/526.2 |

FOREIGN PATENT DOCUMENTS

| | | | |
|---|---|---|---|
| 350133 | 1/1990 | European Pat. Off. . | |
| 634174 | 8/1936 | Germany | 242/526.2 |

*Primary Examiner*—John M. Jillions
*Attorney, Agent, or Firm*—Arthur G. Yeager

[57] ABSTRACT

An apparatus and method for cutting a travelling paper winding on a spool and transferring the web onto an empty spool including a cutting tape passing through an elongated guideway from a near end to a far end; the apparatus and method characterized by attaching a releasable mechanical fastener element to the forward end of the cutting tape and a plurality of other cooperating releasable mechanical fastener element to the far end of an empty spool into grooves forward in the shaft surface and directing the fastener onto the cutting tape to the far end of the empty spool for engagement with the fastener element on the spool to attach the cutting tape to the empty spool. The plurality of fasteners may be employed with both pneumatically-expandable spool shafts and non-expandable shafts having either a steel or rubber surface.

18 Claims, 2 Drawing Sheets

CONTINUOUS WEB MATERIAL TURN UP SYSTEM AND METHOD

CROSS REFERENCE TO RELATED APPLICATIONS

This application is a continuation-in-part of U.S. Ser. No. 08/934,557, filed on Sep. 22, 1997.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

This invention relates to an apparatus and method for cutting a travelling web of paper being wound on one spool and transferring the web to an empty spool while the web is travelling.

2. Related Art

It is a general practice in the paper industry to produce a continuous sheet or web of paper which is wound onto spools. In order to have a continuous operation it is, of course, necessary to have a system for instantaneously switching from winding the web of paper onto a full roll to an empty spool, particularly at modern speeds of paper production. In the prior art there are methods of feeding a tape onto the rotating empty spool core and causing it to be spirally wrapped on that spool core as it stretches tight across the travelling web of paper and cuts the paper, with the cut edge being led onto the empty spool supported by the cutting tape. Subsequent improvements have dealt with methods of stringing the tape for cutting and feeding, and the use of various types of tapes. U.S. Pat. No. 4,414,258 described a tape made of repulpable paper woven into a tape. See also U.S. Pat. Nos. 4,659,029 and 4,783,018 for other tapes and improvements in turn up systems. Improvements are still needed however, to deal with the issues of thermal breakdown of the adhesive used on the cutting tape as well as the need to provide a cutting tape in very dusty environments such as tissue mills where the dust can eliminate the ability to use an exposed adhesive. The improvements should also be specifically adaptable to different spool shafts used in the industry.

BRIEF DESCRIPTION OF THE SEVERAL VIEWS OF THE DRAWING

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

SUMMARY OF THE INVENTION

Figure 1:
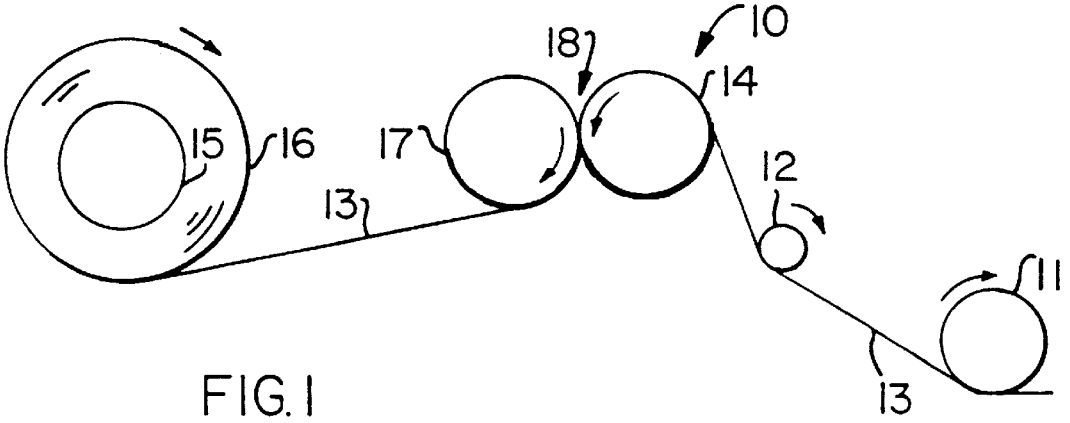
FIG. 1 is a pictorial view of the system of rollers employed in the paper industry to wind the paper web onto rolls.

In one aspect of the present invention, there is provided an apparatus for cutting with a tape a travelling web of paper being wound on a first spool and transferring that travelling web onto an empty spool that is driven by a roller by attaching the tape to the empty spool in a nip between the empty spool and the roller, and a cutting tape is moved beneath and extends beyond the side edges of the web of paper. The improvement includes a mechanical linking means located between the empty spool and the tape for attaching the tape to the empty spool. Other aspects of the present invention are seen wherein the tape has an upper and a lower flat surface and the mechanical linking means includes a pair of cooperating releasable fasteners with one fastener being attached to the cutting tape on one of the flat surfaces and another fastener being attached to the empty spool beyond one edge of said web. The one fastener is attached to one surface of the cutting tape at its forward end before being moved beneath the web of paper. The one fastener covers only a central lengthwise end portion of one surface of the cutting tape. Other features of the improvements include the one fastener being attached to one surface of the cutting tape at its forward end and the other fastener being attached substantially around a circumference of the empty spool beyond the one edge of the web. The improvement further includes spacer means attached between the other fastener and a circumferential surface of the empty spool to elevate the other fastener to enhance proper engagement between the first and second fasteners in a nip between the empty spool and the roller driving the empty spool. The one fastener is formed of a plurality of interlocking elements and the other fastener is formed of a plurality of interlocking elements .

Additional features are found in the mechanical linking means having first and second cooperating elements. The first element is attached to a surface of cutting tape adjacent the forward end thereof and the second element is attached to the empty spool adjacent an outer end thereof. This arrangement also includes spacer means attached to the empty spool for elevating the second element from a circumferential surface of the empty spool to provide for engagement between the elements in the nip between the empty spool and the roller driving the empty spool.

The improvements also include a guideway having an elongate slot facing upwardly underneath the web and extending beyond the side edges of the web for directing the movement of the cutting tape.

In other aspects of the present invention there is provided an improved method for cutting a travelling web of paper being wound on a spool and transferring the web after cutting to an empty spool. The method includes moving a cutting tape to extend beneath and laterally across the web of paper and beyond side edges thereof and introducing the far end of the tape into the nip of the empty spool and the roller driving that spool to cause the tape automatically to spirally wrap around the empty spool while cutting the web of paper. The improvement includes the steps of: attaching a first cooperating releasable fastener to the tape adjacent its forward end; attaching a second cooperating releasable fastener to the circumferential surface of the empty spool; and feeding the forward end of the tape into the nip for attaching the first and second fasteners together to attach the cutting tape to the empty spool to cut and transfer the web of paper thereto. The first step also includes attaching the first fastener to overlie only a central lengthwise forward portion of one surface of the cutting tape. Additional steps include attaching one interlocking material element to one surface of the cutting tape; and attaching an elongated portion of a second interlocking material substantially around the outer perimeter surface of the empty spool outwardly of the edge of the web of paper. This last step also includes attaching a spacer element onto and between the surface of the empty spool and the elongated portion of material to elevate same to enhance the engagement between the interlocking elements in the nip between the empty spool and the roller driving the empty spool.

Additional aspects include moving the cutting tape into a guideway which extends substantially the width of the cutting tape with an elongated slot above the guideway adapted to permit the cutting tape to be pulled out laterally from the guideway. There is an elongated undercut recess below the guideway to permit travel of the first cooperating fastener therethrough and the recess being narrower that the guideway and centered on the guideway. The undercut recess has a width greater than the width of the cutting tape. These steps also include automatically attaching a predetermined length of the first fastener to the cutting tape at the forward end thereof prior to travelling through the guideway to adjacent the far end of the empty spool and attaching the first fastener to the cutting tape with pressure sensitive adhesive material.

DETAILED DESCRIPTION OF THE INVENTION

The conventional turn-up method uses double sided Pressure Sensitive Adhesive Tape (PSAT) to attach a band made from twisted strands of paper (paperband) to a rotating shaft (spool). This method does not always work reliably dependent on the environmental conditions present on a paper machine, especially tissue manufacturing machines. Extreme amounts of paper dust and moisture can be present and inhibit the adhesion properties of the PSAT to function appropriately. If the band does not attach to the spool, the turn-up will not be successful. The present invention involves replacing the PSAT with a part of an attachable mechanical fastener, such as Velcro, and provide a mating part of the fastener (Velcro) on the spool for the paperband to attach itself. During a turn-up, the spool is moved into contact with the reel drum and the paperband is fed into the contact point (nip) of the reel drum and spool, at the area carrying the mating fastener part.

Three different style shafts are used in the industry as the take up roll (spool) for paper, including tissue and therefore two methods of providing the mating fastener part of Velcro on the rotating shaft have to be implemented:

Method 1—Expandable Shaft Application

A fiber core sleeve is slid over an expandable shaft. The shaft is expanded by applying air pressure to an internal expanding tube. Such expansion secures the sleeve to the shaft. A ring with the mating fastener part of Velcro is also mounted on the expandable shaft. The ring is mounted at the location the paperband will be fed into the nip point and is also held into place when the shaft is expanded. A section of the fastener, be it loops or hooks of Velcro is applied to the paperband and loaded via the system. At the appropriate time, the shaft is lowered to the turn-up position. The band is then fed into the point where the shaft and ring is contacting the reel drum. The two mating sections of the fastener meet and provide the attachment of the paperband to the rotating shaft. The system then completes the normal process of cutting and transferring the sheet to the new shaft.

Method 2—Rubber Covered Shaft or Steel Shaft Application

For rubber covered shafts or steel shafts, grooves are milled near the end of the shaft to allow insertion of the fastener parts or strips of Velcro into the grooves. The depth and width of the grooves is consistent with those of the rings used in Method 1. The same process in preparation of the paperband in Method 1 is performed with the application of the fastener part to the paperband, loading the band via the system and feeding the band into the nip during the turn-up. The paperband will be attached to the spool by the mating sections of fastener of Velcro and the system completes the normal process of cutting and transferring the sheet to the new shaft.

This ring can be made from aluminum, steel, fiberglass, plastic or other material depending on size and speed, safety being considered. The number, width and direction of the fastener parts or strips of Velcro on the ring or shaft may vary as necessary depending on machine environmental conditions, speed, size, and width of machinery. The fastener parts as to strip size and type of Velcro may also vary as necessary depending on machine environmental conditions, speed, size and width of machinery. Additionally, the mating parts of Velcro can be interchangeable on the ring or shaft and the paperband.

Figure 2:
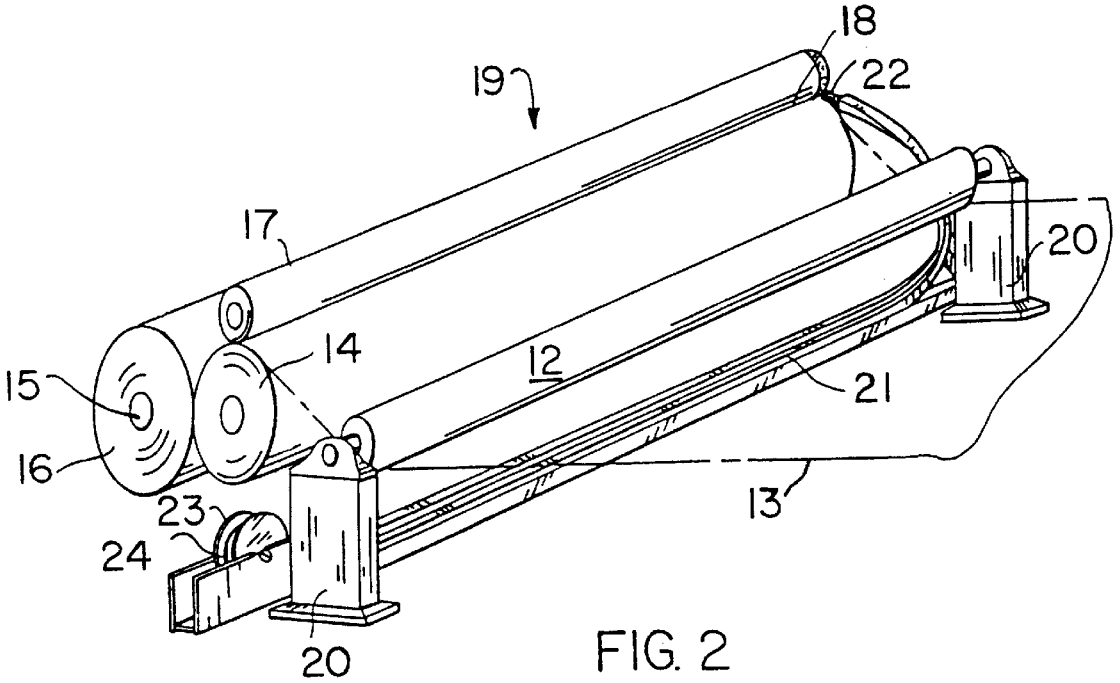
FIG. 2 is a perspective view of the system used to transfer the leading edge of the web to an empty spool in accord with this invention.

The general features of this invention are best seen and understood by reference to FIGS. 1 and 2 which shows some of the equipment employed in a paper manufacturing plant to wind up the manufactured paper on rolls for storage and use elsewhere. A continuous web of paper 13, shown partially and in dotted line, travels at a relatively rapid rate of speed to a combination of spools upon which the paper is rolled. Paper web 13 advances toward tension roll 12, mounted in journals on supports 20, leading web 13 over driving roll 14 and winding paper 16 about spool or roll 15. Driving roll or drum 14 is pressed against the paper on winding roll 15 causing it to rotate. When winding roll 15 has been filled to the desired capacity with paper from web 13, it is necessary to cut web 13 laterally, transfer the cut edge to an empty spool 17, and start the web winding on that spool to eventually produce another filled roll, such as roll 15. Empty spool 17 is positioned generally vertically above the location shown in FIG. 1 until it is ready to accept paper from web 13 and begin winding it up. In order to cause empty spool 17 to begin rotating and to accept the cut edge of web 13, it is necessary to lower spool 17 until it contacts driving roll or drum 14, as shown in FIG. 1, and then to introduce the cut edge of web 13 into the nip 18 between empty spool 17 and driving drum 14 and to cause a transfer of the paper web 13 thereto. Support and/or drive apparatus for members 15, 14 and 17 are not shown for ease of illustration.

Additional apparatus of this invention is generally indicated by reference numeral 19 in FIG. 2 which is a means in the form of a dispenser having tape spool 23 for introducing a tape 24 to the far edge area of empty spool 17 and causing that tape 24 to wrap around spool 17 in a spiral fashion, and, in so doing, cut web 13 and cause the cut edge to be introduced onto empty spool 17 and to transfer the cut web 13 to become wrapped about spool 17. Guideway 21 is used to direct the passage of tape 24 having complemental fastener 22 for connection to fasteners 31, 37 or 43 to the far edge of area of spool 17. Guideway 21 is more specifically shown and described in U.S. Pat. No. 4,783,018 and copending application Ser. No. 08/934,557 referenced above.

Figure 3:
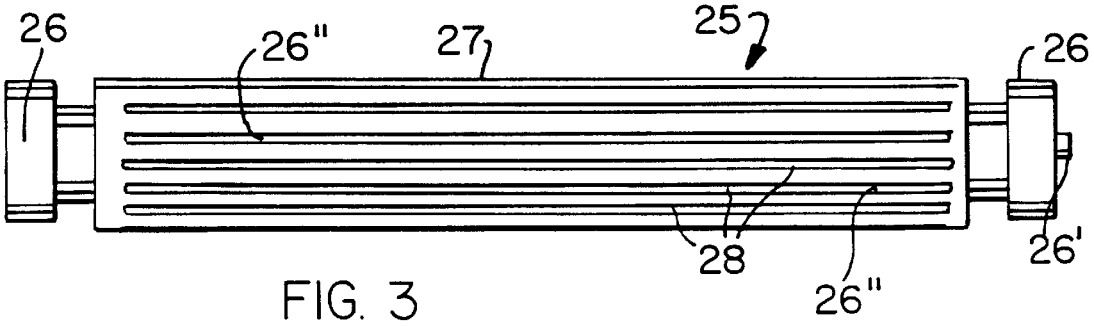
FIG. 3 is a side elevation view of one of the spools used in accord with the present invention.
Figure 4:
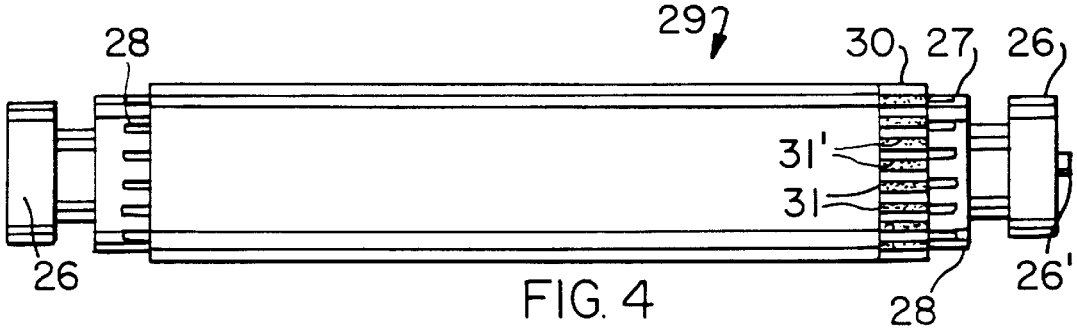
FIG. 4 is a side elevation view of the spool of FIG. 1 covered with a fiber core in accord with the present invention.

With reference now to FIGS. 3 and 4, one embodiment of spool 17 is shown. The spool 12 is comprised of a pneumatically expandable elongate shaft 25 having air inlet fitting 26'. The shaft 25 is mounted on axle ends 26 by which it is rotated via plant roller drive apparatus (not shown). The body 27 has expansion splines 28. FIG. 4 illustrates an elongate fiber core 29 and a ring member 30 comprising a sleeve means that is carried by shaft 25 and held thereon when the shaft 25 is pneumatically expanded via an internal air tube 26". Grooves or slots 31' formed in ring 30 hold releasable fasteners such as the hook or pad element of a pair of Velcro members. Core 29 is sized in thickness to provide that the upper surface of fasteners 31 will be aligned laterally with the surface of core 29 to provide a proper continuous surface for web 13 thereon. It is to be understood that core 29 and ring 30 could be a single unitary component if considerations such as cost allow.

Figure 5:
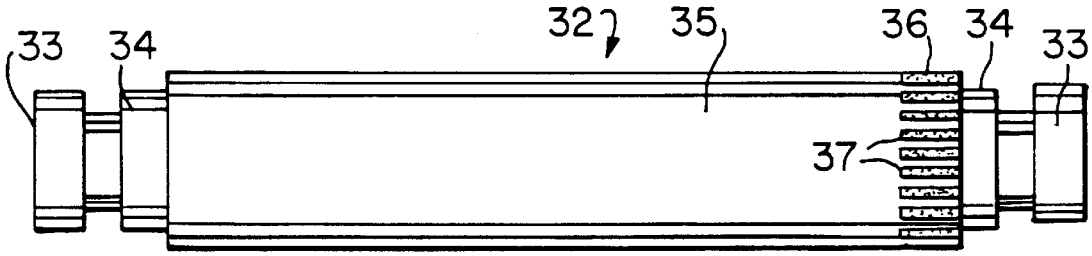
FIG. 5 is a side elevation view of a second spool used in accord with the present invention.

FIG. 5 illustrates a spool 32 having a shaft 34 and axle ends 33. Shaft 34 has a metal surface 35. Grooves or slots 36 are cut into the surface material 35 to provide space for Velcro sections 37.

Figure 6:
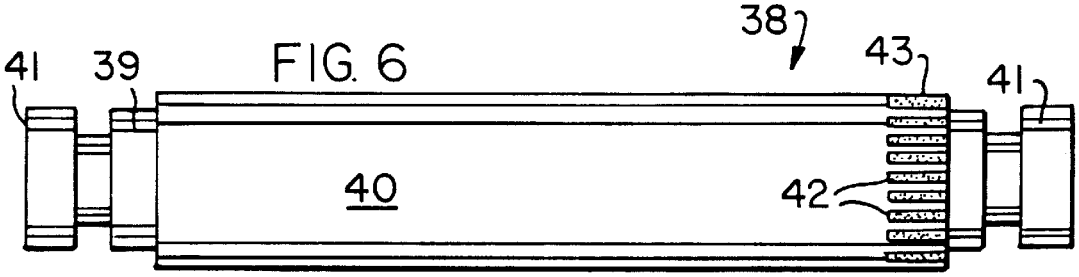
FIG. 6 is a side elevation of a third spool used in accord with the present invention.

FIG. 6 illustrates a spool 38 having a shaft 39 with a rubber covering 40. Axles 41 provide rotational support. Grooves 42 are formed in the covering 40 for Velcro sections 43.

In both FIGS. 5 and 6, the number, space, size and length of grooves 36, 42 and Velcro sections 37, 43 depend in the circumstances on such factors as the web material, machine speed and other variables as understood in the art.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. In a system for cutting with a tape a travelling web of paper being wound on a first spool and transferring that travelling web onto an empty spool having an elongate shaft being driven by a roller by attaching said tape to said empty spool in a nip between said empty spool and said roller, said cutting tape being moved beneath and extending beyond the side edges of the web of paper and including mechanical linking means located between said empty spool and said tape for attaching said tape to said empty spool; the improvement comprising an elongate sleeve means having opposite end portions carried on said shaft, said mechanical linking means including a plurality of cooperable releasable fasteners carried adjacent one said end portion of said sleeve means and at least one cooperable releasable fastener attached to said tapes said sleeve means including an elongate sleeve and a ring member, said plurality of releasable fasteners being attached to and carried by said ring member.

2. The system of claim 1 wherein each said fastener is formed of a plurality of interlocking elements.

3. The system of claim 2 wherein said one fastener attached to said cutting tape is attached to one surface of said cutting tape at its forward end before being moved beneath the web of paper.

4. The system of claim 2 wherein said one fastener attached to said cutting tape is attached to said cutting tape at its forward end and said other fastener is attached substantially spacedly around a circumference of said sleeve means adjacent said one end portion beyond said one edge of said web.

5. The system of claim 1 wherein said shaft is expandable in diameter, said elongate sleeve means being secured to said shaft by the expansion of said shaft when said shaft is expanded.

6. The system of claim 1 wherein one said end portion of said sleeve means includes a plurality of circumferentially spaced grooves formed therein, each said fastener carried adjacent said one end portion of said sleeve being attached to said sleeve inside a respective said groove.

7. The system of claim 1 wherein said plurality of releasable fasteners being spaced circumferentially around said ring member.

8. In an apparatus for cutting with a tape a travelling web of paper being wound on a first spool and transferring that travelling web onto an empty spool having an elongate shaft with opposite end portions being driven by a roller by attaching said tape to said empty spool in a nip between said empty spool and said roller, said cutting tape being moved beneath and extending beyond the side edges of the web of paper and including mechanical linking means located between said empty spool and said tape for attaching said tape to said empty spool; the improvement comprising a plurality of spaced grooves formed in said shaft adjacent one said end portion, said mechanical linking means including a plurality of cooperable releasable fasteners each carried in a respective said groove and at least one cooperable releasable fastener attached to said tape.

9. The apparatus of claim 8 wherein said one fastener attached to said cutting tape is attached to said cutting tape at its forward end and said plurality of other fasteners are attached to said shaft in said grooves, said grooves being located beyond one side edge of said web.

10. The apparatus of claim 9 wherein said grooves are spacedly located around the circumference of said shaft.

11. The apparatus of claim 10 wherein said shaft has a rubber surface, said plurality of grooves being spacedly located circumferentially around said one end portion of said shaft.

12. The apparatus of claim 8 wherein said shaft has a metal surface, said plurality of grooves being spacedly located circumferentially around said one end portion of said shaft.

13. The apparatus of claim 8 wherein said plurality of spaced grooves extend in a direction generally parallel to a longitudinal axis of said shaft.

14. An improved method for cutting a travelling web of paper being wound on a spool and transferring the web after cutting to an empty spool having an elongate shaft, the method including moving a cutting tape to extend beneath and laterally across the web of paper and beyond side edges thereof; introducing the far end of the tape into the nip of the empty spool and the roller driving that spool to cause the tape automatically to spirally wrap around the empty spool while cutting the web of paper; wherein the improvement comprises the steps of:

A. attaching a first cooperating releasable fastener to the tape adjacent its forward end;

B. mounting an elongate sleeve over the shaft;

C. mounting a ring member on the shaft adjacent one end portion of the sleeve;

D. attaching a plurality of second cooperating releasable fasteners to the circumferential surface of the ring member; and E. feeding the forward end of the tape into the nip for attaching the first and second fasteners together to attach the cutting tape to the empty spool to cut and transfer the web of paper thereto.

15. The method of claim 14 wherein step A includes the step of:

F. attaching one interlocking material element to one surface of the cutting tape; and wherein step C includes the step of:

G. attaching a plurality of second interlocking material elements to the outer perimeter surface of the ring member.

16. An improved method for cutting a travelling web of paper being wound on a spool and transferring the web after cutting to an empty spool having an elongate shaft, the method including moving a cutting tape to extend beneath and laterally across the web of paper and beyond side edges thereof introducing the far end of the tape into the nip of the empty spool and the roller driving that spool to cause the tape automatically to spirally wrap around the empty spool while cutting the web of paper; wherein the improvement comprises the steps of:

A. attaching a first cooperating releasable fastener to the tape adjacent its forward end;

B. attaching a plurality of second cooperating releasable fasteners to the circumferential surface of the empty spool;

C. feeding the forward end of the tape into the nip for attaching the first and second fasteners together to attach the cutting tape to the empty spool to cut and transfer the web of paper thereto;

D. forming a plurality of spaced grooves in the shaft adjacent one end of the shaft;

E. attaching each of the plurality of fasteners in a respective groove: and

F. forming the grooves circumferentially around the end of the shaft adjacent the outer perimeter thereof.

17. An improved method for cutting a travelling web of paper being wound on a spool and transferring the web after cutting to an empty spool having and elongate shaft, the method including moving a cutting tape to extend beneath and laterally across the web of paper and beyond side edges thereof; introducing the far end of the tape into the nip of the empty spool and the roller driving that spool to cause the tape automatically to spirally wrap around the empty spool while cutting the web of paper; wherein the improvement comprises the steps of:

A. attaching a first cooperating releasable fastener to the tape adjacent its forward end;

B. forming a plurality of spaced grooves at one end portion of a sleeve on its outer surface;

C. mounting an elongate sleeve over the shaft;

D. attaching a plurality of second cooperating releasable fasteners to the respective grooves of the sleeve; and E. feeding the forward end of the tape into the nip for attaching the first and second fasteners together to attach the cutting tape to the empty spool to cut and transfer the web of paper thereto.

18. The method of claim 17 wherein step B includes locating grooves in a direction generally parallel to a longitudinal axis of the shaft.

* * * * *